US009863736B2

(12) United States Patent
Kelly et al.

(10) Patent No.: US 9,863,736 B2
(45) Date of Patent: Jan. 9, 2018

(54) ARCHERY RELEASE ASSEMBLY AND METHOD

(71) Applicant: Scott Archery LLC, Clay, KY (US)

(72) Inventors: Daniel N. Kelly, Rochester, NY (US); Eric J. Griggs, Stanton, KY (US)

(73) Assignee: Scott Archery LLC, Stanton, KY (US)

( * ) Notice: Subject to any disclaimer, the term of this patent is extended or adjusted under 35 U.S.C. 154(b) by 0 days.

(21) Appl. No.: 15/467,563

(22) Filed: Mar. 23, 2017

(65) Prior Publication Data

US 2017/0191789 A1 Jul. 6, 2017

Related U.S. Application Data

(63) Continuation of application No. 15/008,962, filed on Jan. 28, 2016, now Pat. No. 9,625,230, which is a continuation of application No. 14/500,337, filed on Sep. 29, 2014, now Pat. No. 9,255,762.

(60) Provisional application No. 61/883,422, filed on Sep. 27, 2013, provisional application No. 61/884,493, filed on Sep. 30, 2013.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS

| | | | | | |
|---|---|---|---|---|---|
| 228,302 | A | | 6/1880 | Beard | |
| 229,089 | A | | 6/1880 | Burnham | |
| 2,133,650 | A | | 10/1938 | Baker | |
| 3,768,456 | A | * | 10/1973 | Hansen | F41B 5/1469 124/35.2 |
| 3,853,111 | A | * | 12/1974 | Stanislawski | F41B 5/1469 124/35.2 |
| 3,965,884 | A | * | 6/1976 | Killian | F41B 5/1469 124/35.2 |
| 4,036,204 | A | | 7/1977 | Scott | |
| 4,041,926 | A | | 8/1977 | Troncoso, Jr. et al. | |
| 4,160,437 | A | | 7/1979 | Fletcher | |
| 4,424,791 | A | * | 1/1984 | Muehleisen | F41B 5/1469 124/35.2 |
| 4,509,497 | A | | 4/1985 | Garvison | |
| 4,539,968 | A | | 9/1985 | Garvison | |
| 4,567,875 | A | | 2/1986 | Fletcher | |

(Continued)

OTHER PUBLICATIONS

Various prior art releases (1) downloaded from http://www.archeryhistory.com/releases/releasespics/pse.jpg, Dec. 2009.

(Continued)

*Primary Examiner* — Alexander Niconovich
(74) *Attorney, Agent, or Firm* — Barclay Damon LLP

(57) ABSTRACT

An archery release assembly and method are disclosed herein. The assembly, in an embodiment, includes a body having a first structure having a first finger engagement surface and a second structure defining a recess and an axial space. The assembly also includes a hook pivotally coupled to the body and an extension having a protrusion configured to be inserted into the recess. Also, the assembly includes a member configured to be at least partially positioned within the axial space.

29 Claims, 10 Drawing Sheets

(56) References Cited

U.S. PATENT DOCUMENTS

| | | | | |
|---|---|---|---|---|
| 4,574,767 | A | 3/1986 | Gazzara | |
| 4,612,907 | A | 9/1986 | Gantt | |
| 4,620,523 | A | 11/1986 | Peck | |
| 4,674,469 | A | 6/1987 | Peck | |
| 4,854,293 | A | 8/1989 | Roberts | |
| 4,881,516 | A | 11/1989 | Peck | |
| 5,009,214 | A | 4/1991 | Wilde | |
| 5,025,772 | A * | 6/1991 | Stevenson | F41B 5/1469 124/35.2 |
| 5,205,268 | A | 4/1993 | Savage | |
| 5,261,581 | A | 11/1993 | Harden | |
| 5,273,021 | A | 12/1993 | Tepper | |
| 5,323,754 | A | 6/1994 | Pittman et al. | |
| 5,448,983 | A | 9/1995 | Scott | |
| 5,546,924 | A | 8/1996 | Todd | |
| 5,596,977 | A | 1/1997 | Scott | |
| 5,685,286 | A | 11/1997 | Summers | |
| 5,692,490 | A * | 12/1997 | Walker | F41B 5/1469 124/35.2 |
| 5,694,915 | A * | 12/1997 | Summers | F41B 5/1469 124/35.2 |
| 5,765,536 | A | 6/1998 | Scott | |
| 5,803,068 | A | 9/1998 | Summers | |
| 5,937,842 | A | 8/1999 | Summers et al. | |
| 6,032,661 | A | 3/2000 | Goff et al. | |
| 6,302,093 | B1 | 10/2001 | Holland | |
| 6,571,786 | B2 | 6/2003 | Summers et al. | |
| 6,631,709 | B2 * | 10/2003 | Carter | F41B 5/1469 124/35.2 |
| 6,647,976 | B2 * | 11/2003 | Summers | F41B 5/1469 124/35.2 |
| 6,712,060 | B2 | 3/2004 | Egusquiza | |
| 6,736,124 | B2 * | 5/2004 | Carter | F41B 5/1469 124/35.2 |
| 6,895,951 | B2 | 5/2005 | Summers et al. | |
| 6,945,241 | B2 | 9/2005 | Pellerite | |
| D597,164 | S | 7/2009 | Jones | |
| 7,654,254 | B1 * | 2/2010 | Rentz | F41B 5/1469 124/35.2 |
| 8,622,051 | B2 | 1/2014 | Summers | |
| 8,746,221 | B2 | 6/2014 | Rentz | |
| 9,618,295 | B1 * | 4/2017 | Rentz | F41B 5/1469 |
| 2003/0159682 | A1 * | 8/2003 | Pellerite | F41B 5/1469 124/35.2 |
| 2004/0079351 | A1 * | 4/2004 | Summers | F41B 5/1469 124/35.2 |
| 2008/0149084 | A1 * | 6/2008 | Whalen | F41B 5/1469 124/35.2 |
| 2009/0056689 | A1 * | 3/2009 | Jones | F41B 5/1469 124/35.2 |
| 2009/0090342 | A1 | 4/2009 | Freitag et al. | |
| 2009/0095270 | A1 | 4/2009 | Graves | |
| 2010/0108047 | A1 | 5/2010 | Jones | |
| 2011/0168146 | A1 * | 7/2011 | Deceuster | F41B 5/1469 124/35.2 |
| 2012/0192844 | A1 * | 8/2012 | Springer | F41B 5/1469 124/35.2 |
| 2012/0285431 | A1 * | 11/2012 | Summers | F41B 5/1469 124/35.2 |
| 2013/0025578 | A1 * | 1/2013 | Jones | F41B 5/1469 124/35.2 |
| 2013/0092140 | A1 * | 4/2013 | Rentz | F41B 5/1469 124/35.2 |
| 2015/0219418 | A1 * | 8/2015 | Whalen | F41B 5/1469 124/35.2 |

OTHER PUBLICATIONS

Various prior art releases (2) downloaded from http://www.archeryhistory.com/releases/releasespics/release4.jpg, Dec. 2009.
Prior art releases (3) downloaded from http://www.archeryhistory.com/releases on Jul. 21, 2011.
Prior art releases (4) downloaded from http://www.archeryhistory.com/releases on Jul. 21, 2011.
Longhorn Hunter (Jan. 2010).

* cited by examiner

ARCHERY RELEASE ASSEMBLY AND METHOD

CROSS-REFERENCE TO RELATED APPLICATIONS

This application is a continuation of, and claims the benefit and priority of, U.S. patent application Ser. No. 15/008,962 filed on Jan. 28, 2016, which is a continuation of, and claims the benefit and priority of, U.S. patent application Ser. No. 14/500,337 (now U.S. Pat. No. 9,255,762) filed on Sep. 29, 2014, which is a non-provisional of, and claims the benefit and priority of: (i) U.S. Patent Application No. 61/883,422 filed on Sep. 27, 2013; and (ii) U.S. Patent Application No. 61/884,493 filed on Sep. 30, 2013. The entire contents of such applications are hereby incorporated by reference.

BACKGROUND

The subject matter disclosed herein relates to archery releases and to triggerless back tension releases in particular.

Archery releases are designed to hold a bowstring so that an archer can pull on the release and draw the bowstring with the release. Archery releases assist the archer in cleanly and consistently releasing the bowstring when the archer shoots an arrow from the bow. This increases the accuracy of the archer's shot.

There are a variety of archery releases available including trigger releases and back tension releases. A trigger release typically includes a trigger mechanism and one or more moveable jaws joined with the trigger mechanism. The moveable jaws are configured to hold a bowstring of a bow. When activated by the archer's finger, the trigger mechanism moves the moveable jaws to release the bowstring. A back tension release typically includes a release handle, a release head bracket pivotally secured to the handle, and a hook pivotally secured to the release head bracket. The hook is configured to hold the bowstring, and is also adapted to engage a pawl. To operate the release so that it releases a bowstring held in the hook, an archer holds the handle, and squeezes the archer's shoulder blades together or, in other words, "tense their back." Because the archer holds the device in their hand by the handle, tensing of the back muscles moves the hand and, in turn, rotates the release slightly. This slight rotation moves the release enough so that the hook disengages the pawl, and thereby becomes free to move and release the bowstring. The discussion above is merely provided for general background information and is not intended to be used as an aid in determining the scope of the claimed subject matter.

SUMMARY

A triggerless back tension archery release is provided. Disclosed archery releases include a bearing ring that rotates relative to a release body. During use, the bearing ring rotates to the same position when force is applied during a draw cycle. This reduces inconsistent placement of the finger and provides consistent release alignment. Disclosed archery releases also include a variety of removable finger extension that provide high mass triggers. An archer can feel subtle movement of the high mass triggers with increased accuracy which provides better control over the archery release.

An advantage that may be realized in the practice of some disclosed embodiments of the back tension archery release is that an archer can feel the subtle movements of a high mass trigger and this provides increased control.

In a first embodiment, a triggerless back tension archery release is provided. The release comprises a release body, a finger extension removably connected to the release body, and a triggerless hook assembly connected to the release body. The triggerless hook assembly is configured to selectively release a bowstring upon actuation of the finger extension. The release has a total weight and at least 50% of the total weight is in the finger extension.

In a second embodiment, a triggerless back tension archery release is provided. The release comprises a release body, a finger extension removably connected to the release body, the finger extension consisting essentially of stainless steel, aluminum or brass. A triggerless hook assembly is connected to the release body and is configured to selectively release a bowstring upon actuation of the finger extension. The release has a total weight and at least 50% of the total weight is in the finger extension.

In a third embodiment, a kit is provided. The kit comprises a three-finger extension configured to connect to a recess within a release body and a four-finger extension configured to connect to the recess within the release body. The kit further comprises a triggerless back tension archery release comprising the release body with the recess, wherein the recess is configured to connect to a finger extension selected from the group consisting of the three-finger extension and the four-finger extension. The release comprises a triggerless hook assembly connected to the release body that is configured to selectively release a bowstring upon actuation of the finger extension. The release has a total weight and at least 50% of the total weight is in the finger extension.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

Figure 1:
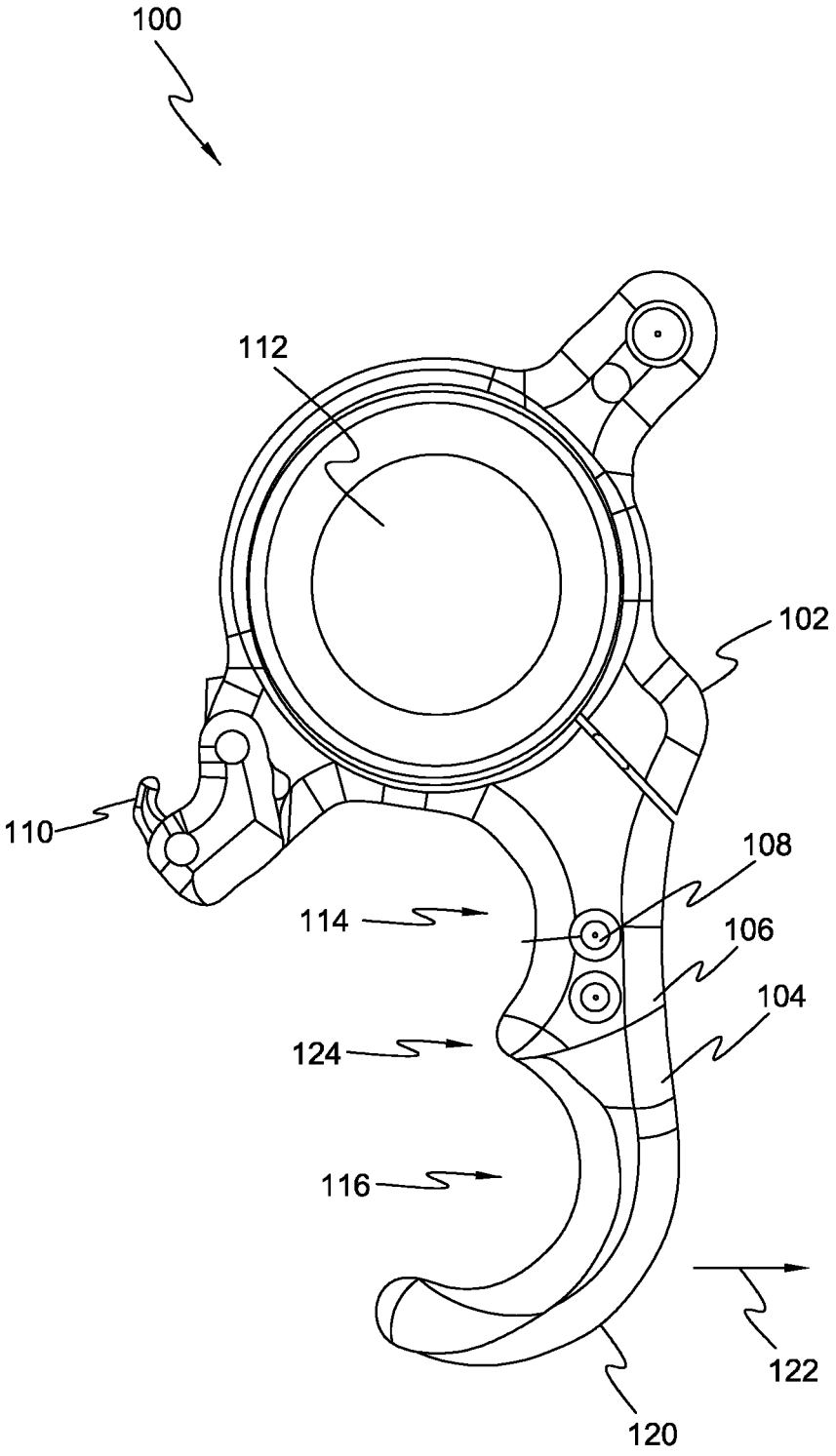
FIG. 1 depicts an exemplary release with a three-finger extension.

FIG. 1 depicts an exemplary release 100 for use in archery. The release 100 includes a release body 102 and a three-finger extension 104. The release 100 is a triggerless back-tension release. The three-finger extension 104 is attached to the release body 102 at junction 106. A protrusion in the three-finger extension 104 fits into a recess in the release body 102 and is securely mounted therein by at least one member or bolt 108. In one embodiment, the bolt 108 is a hex-bolt or other suitable means for securing. The bolt 108 is removable such that the three-finger extension 104 can be withdrawn from the recess and replaced with a different finger extension.

In use, an archer places a bowstring of a bow within a bearing hook 110. In the embodiment of FIG. 1, the three-finger extension 104 permits the release 100 to be used as a three-finger release. An index finger is placed in a first finger position 112, a middle finger is placed in a second finger position 114 and a ring finger is placed in a third finger position 116. A crest 124 is provided to separate the first finger position 112 from the second finger position 114. In a back tension release, the release is actuated to release the bowstring by moving a distal end of the finger extension in a backward direction. The archer performs this actuation by tensioning his or her back while minimizing any movement of the release 100 that may negatively effect the release of the bowstring. For example, in the embodiment of FIG. 1, an archer moves a distal end 120 of the three-finger extension 104 in a backward direction 122 to trigger release of the bowstring.

Figure 2:
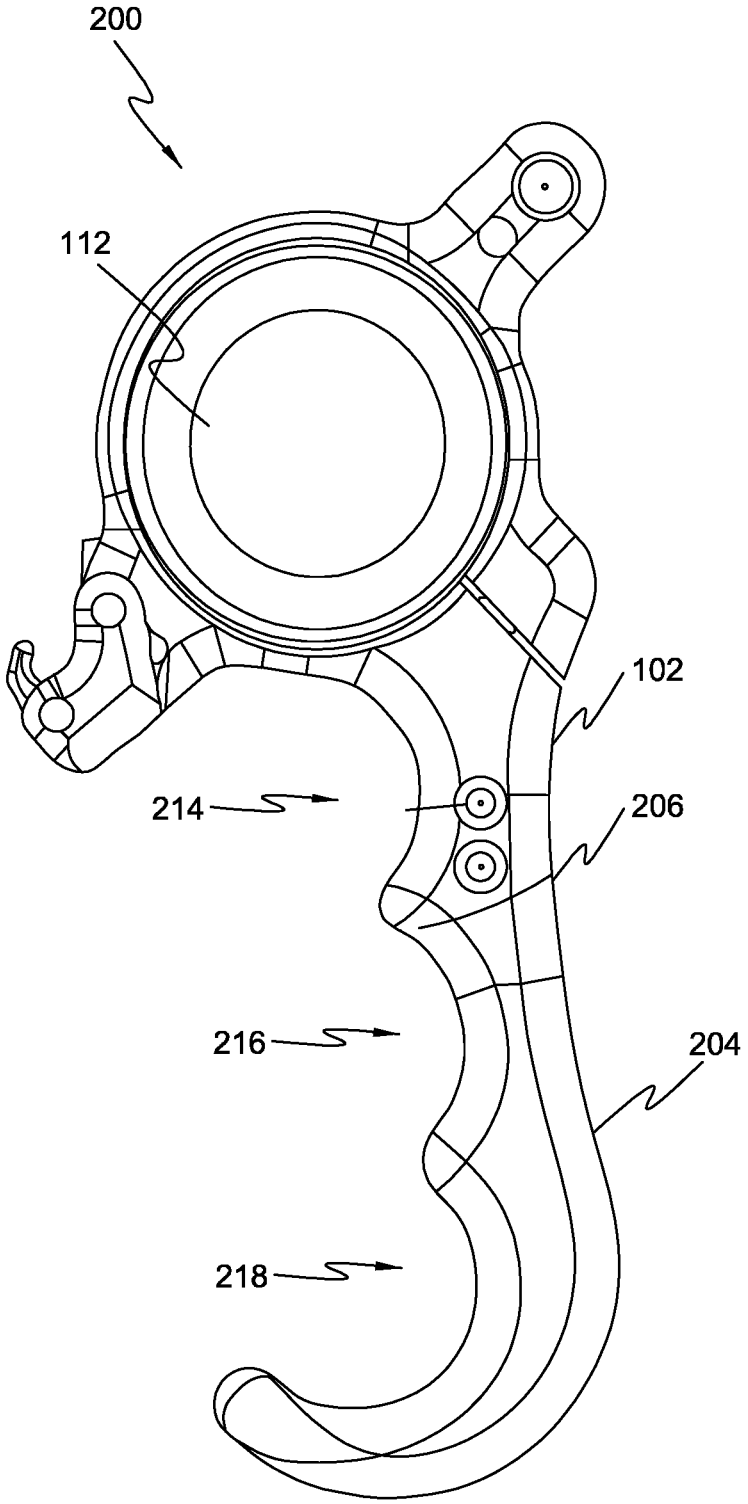
FIG. 2 depicts an exemplary release with a four-finger extension.

FIG. 2 depicts another release 200 that attaches the release body 102 to a four-finger extension 204 at a junction 206. An index finger is placed in the first finger position 112, a middle finger is placed in a second finger position 214, a ring finger is placed in a third finger position 216 and the small finger is placed in a fourth finger position 218.

Some archers prefer to use a particular number of fingers when using a release. Examples of such preferences include two-finger releases, three-finger releases and four-finger releases. Other archers prefer the reverse. The removable finger extensions 104, 204 permit archers the option of connecting a preferred finger extension to a common release body 102.

The finger extensions are weighted to provide better control in the shooting of the release. In one embodiment, at least about 50% of the release's total weight is in the finger extension. In one embodiment, the finger extensions consist essentially of a metal, such as stainless steel or aluminum. In one exemplary embodiment a three-finger extension that consists essentially of stainless steel has at least about 55% of the release's total weight in the finger extension. Likewise, a three-finger extension that consists essentially of aluminum has at least about 18% of the release's total weight in the finger extension. In the exemplary embodiment of FIG. 2, a four-finger extension that consists essentially of stainless steel has at least about 90% of the release's total weight in the finger extension. Likewise, a four-finger extension that consists essentially of aluminum has at least about 55% of the release's total weight in the finger extension. Alternative metals include brass. Without wishing to be bound to any particular theory, the weighting may alter the inertia of the release to provide better feedback to the user. The high mass in the finger extension provides the archer with a level of control over the release that is better than the control from releases with low mass triggers. The archer can feel the subtle movements of the release more easily than is possible with low mass triggers. This permits better control.

Figure 3C:
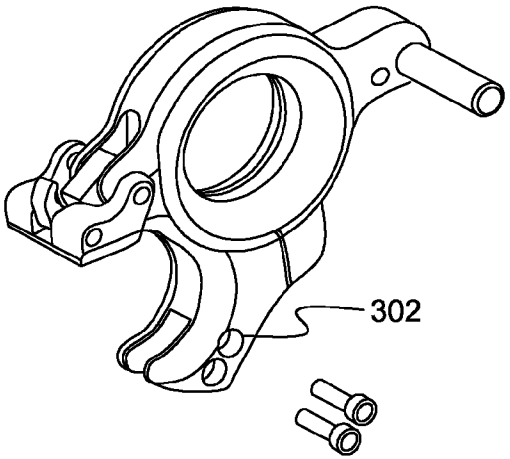
FIG. 3A, FIG. 3B and FIG. 3C are perspective views of three exemplary releases with a four-finger extension, a three-finger extension and a two-finger extension, respectively.
Figure 3B:
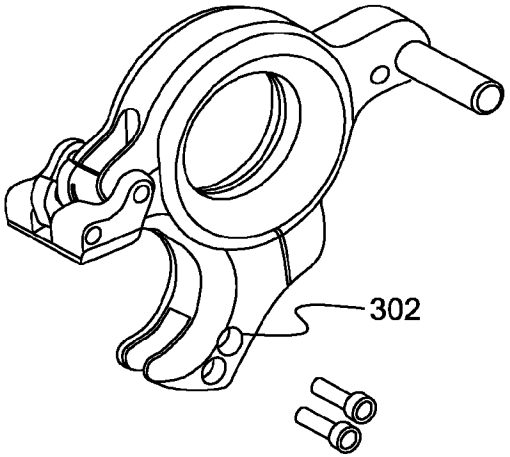
Figure 3A:
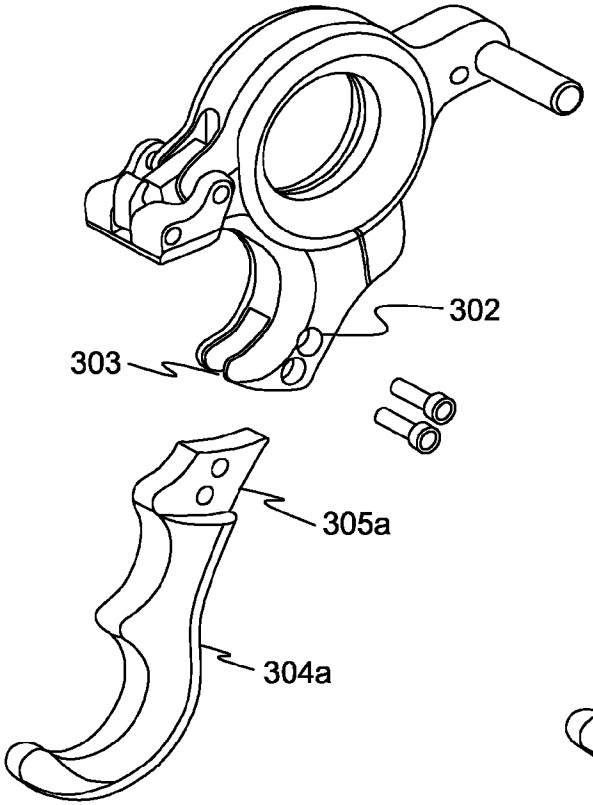

FIG. 3A, FIG. 3B and FIG. 3C depict a release body 302 that comprises a recess 303 that receives a protrusion 305*a*, 305*b*, or 305*c* of a respective finger extension 304*a*, 304*b* or 304*c*. The protrusions 305*a*, 305*b*, or 305*c* are substantially identical such that each mates with the recess 303 to render the finger extensions interchangeable. Finger extension 304*a* is a four-finger extension. Finger extension 304*b* is a three-finger extension. Finger extension 304*c* is a two-finger extension.

Figure 4B:
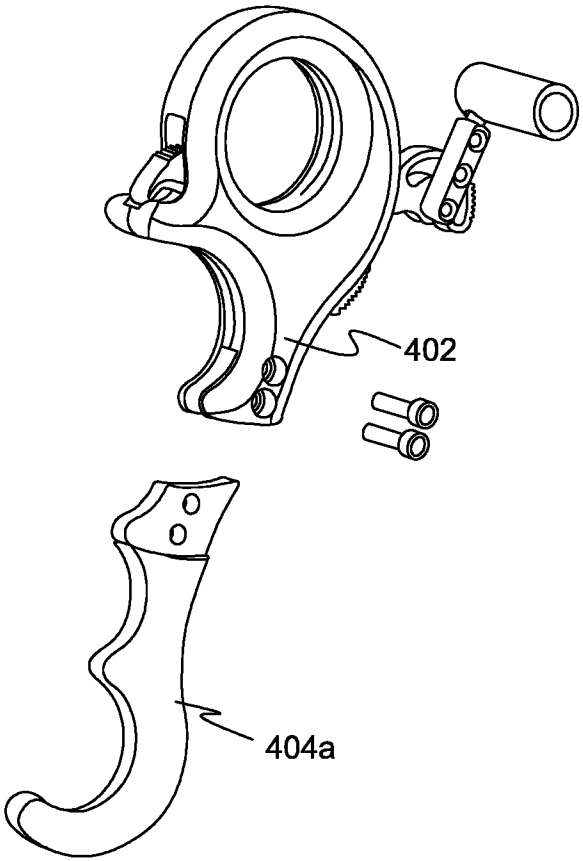
FIG. 4A and FIG. 4B are perspective views of two exemplary releases with a three-finger extension and a four-finger extension, respectively.
Figure 4A:
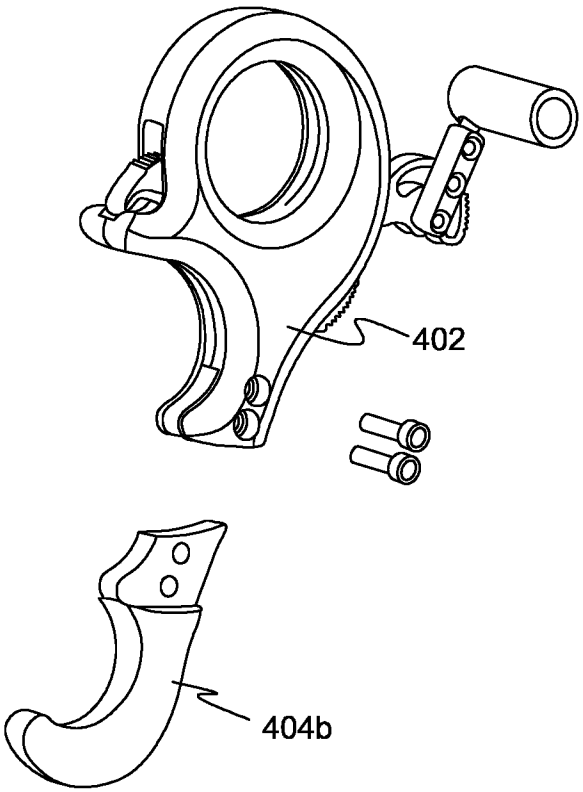
Figure 5A:
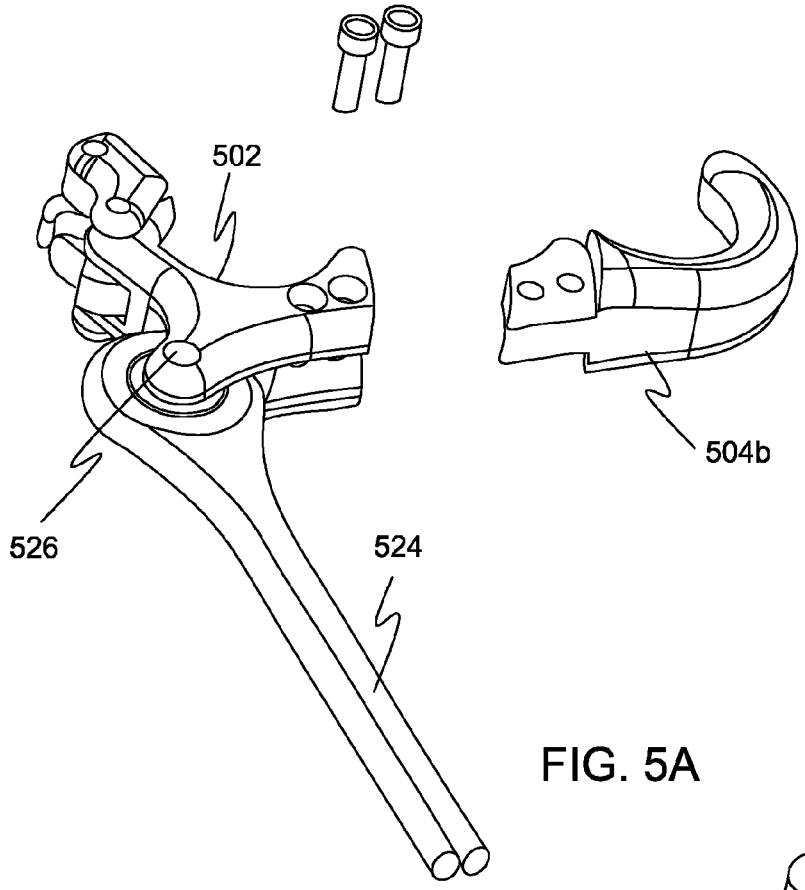
FIG. 5A and FIG. 5B are perspective views of two exemplary releases that use a strap, wherein the views include a two-finger extension and a three-finger extension, respectively.
Figure 5B:
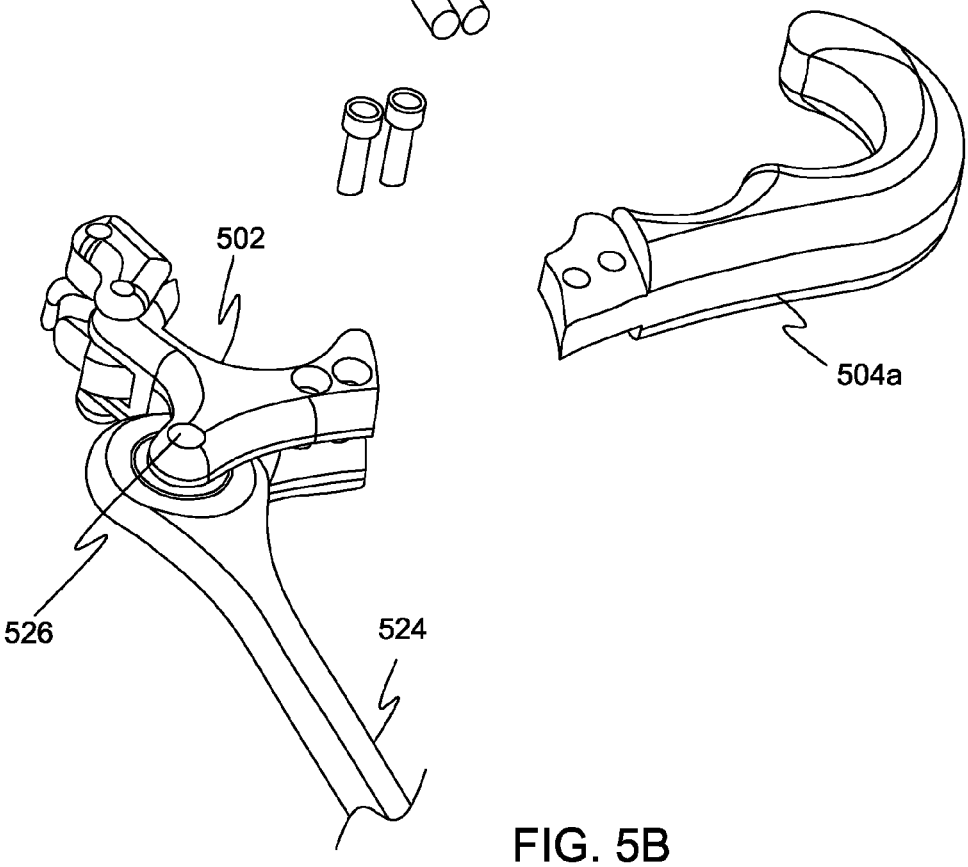

FIG. 4A and FIG. 4B depict alternative embodiments where various finger extensions 404*a*, 404*b* are attached to a common release body 402. As shown in FIG. 5A and FIG. 5B, the finger extensions may also be used on a strap-style back tension release as well. In FIG. 5A, a release body 502 is attached to a two-finger extension 504*b*. A strap 524 connects to the release body 502 at a pivot point 526. The strap 524 may be disposed about the archer's wrist or otherwise configured to help the archer draw the bowstring. FIG. 5B shows a three-finger extension 504*a* connected to the release body 502. In one embodiment, a kit is provided that includes a release body and at least two-finger extensions selected from a two-finger extension, a three-finger extension and a four-finger extension. The archer may selectively use a finger release according to the archer's preference.

Figure 6:
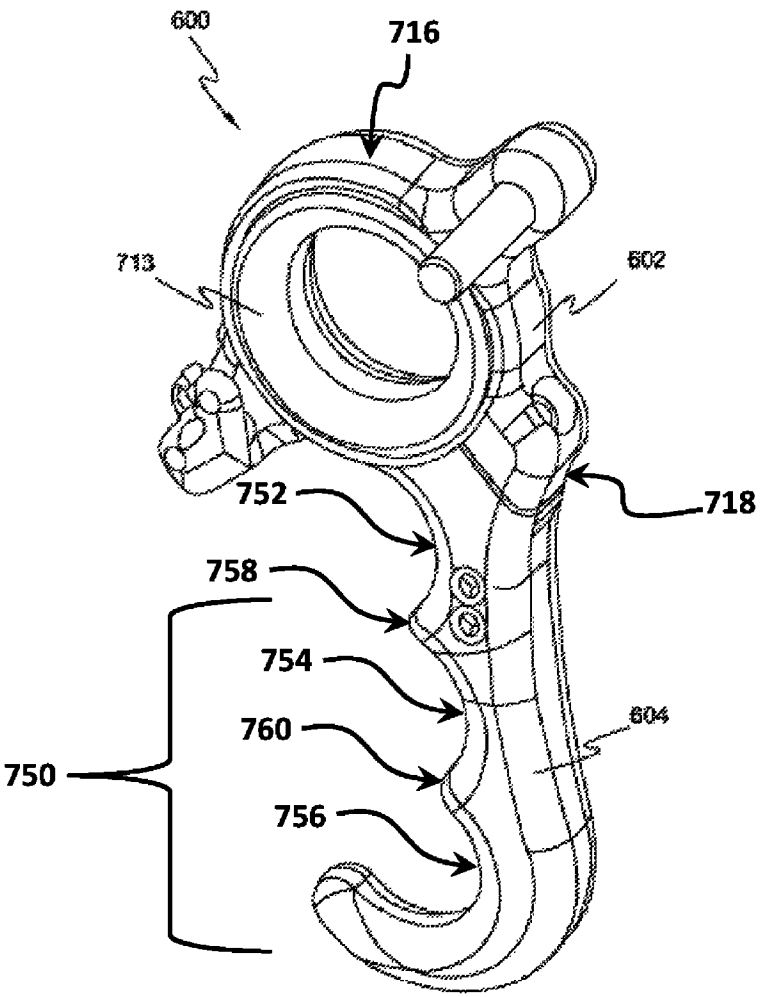
FIG. 6 is a perspective view of an exemplary release comprising a four-finger extension.
Figure 7:
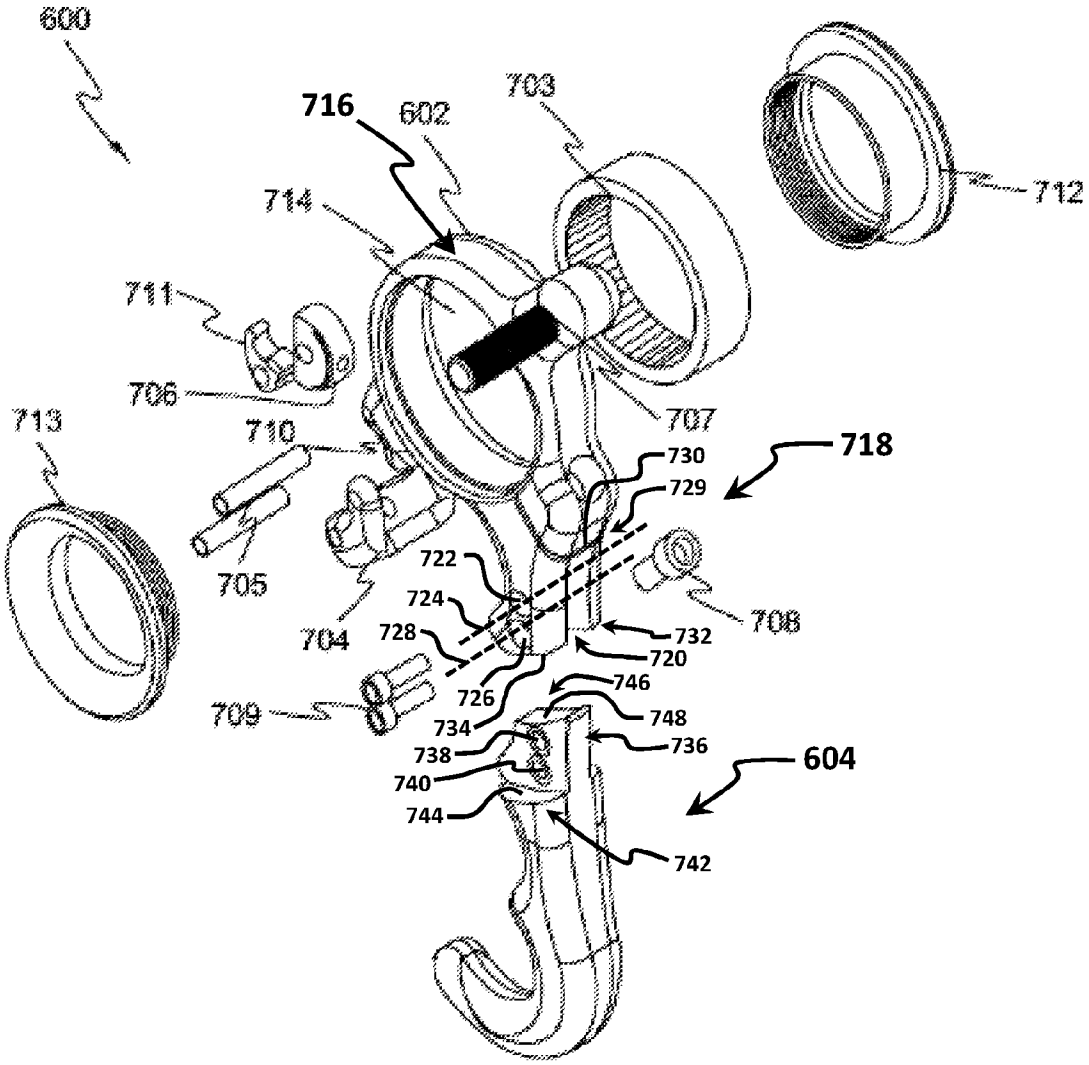
FIG. 7 is an exploded view of an exemplary release comprising a four-finger extension.
Figure 8:
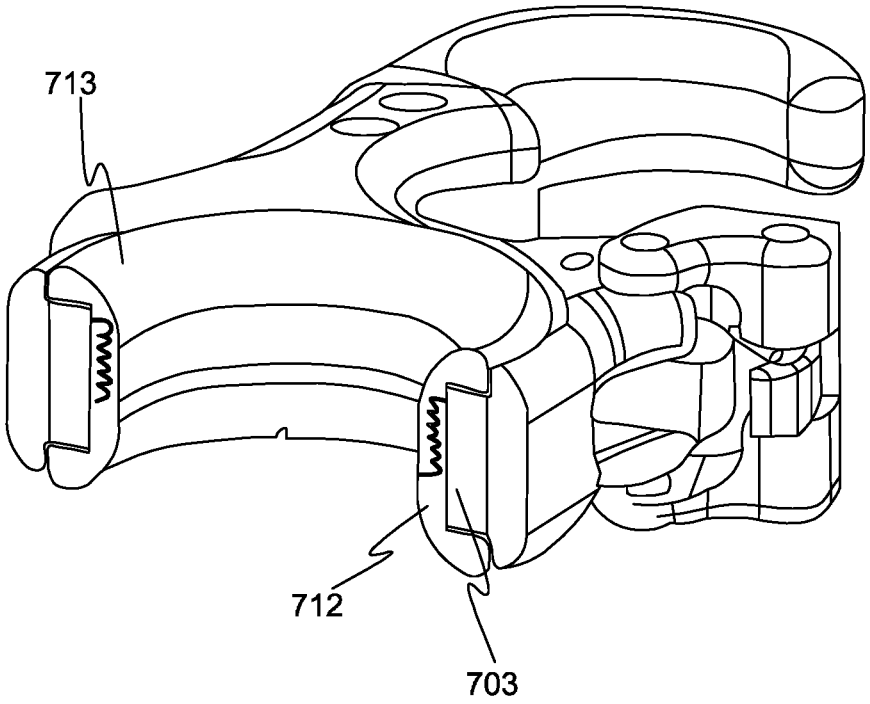
FIG. 8 is a cross section view of a release body of an exemplary release.

FIG. 6 depicts a release 600 with a release body 602 having a bearing ring 713. The release body 602 is releasably connected to a finger extension 604. FIG. 7 is an exploded view of the release 600 of FIG. 6. In another embodiment, not shown, a monolithic release is provided where a release body is monolithic with regard to a finger extension. In the embodiment of FIG. 7, the release body 602 comprises a first structure or ring structure 716 defining a circular hole 714 housing a ring-shaped bearing 703 disposed therein. The release body 602 also includes a second structure or mount structure 718 defining: a recess 720; a first axial space or first mount space 722 extending along a first axis 724; and a second axial space or second mount space 726 extending along a second axis 728. The mount structure 718 includes an interference portion 729 including an inner surface 730, and the mount structure 718 includes: an interference portion 732 including an end 734 of the mount structure 718; a plurality of spaced-apart supports 731, 733 (FIG. 10) which, as shown, have a fork shape defining the recess 720 (FIG. 10) between the supports 731, 733. Also, the extension 604 includes: a protrusion 736 defining first and second protrusion passages 738, 740; a stop portion 742 having a step-shaped portion 744; and a stop portion 746 including an end 748 of the extension 604. As shown in FIG. 6, when assembled, the grasp 750 of the extension 604 and the mount structure 718 define a plurality of valleys 752, 754, 756 separated by a plurality of crests 758, 760. A pair of bearing rings 712/713 are disposed about the ring-shaped bearing 703. Each of the bearing rings 712/713 has a lip with a radius that is larger than the radius of the ring-shaped bearing 703. Each of the bearing rings 712/713 also has a threaded ridge on a respective inner and outer wall of a collar. The threaded ridges are mated engage each other to secure the bearing rings 712/713 to one another while rotatably securing the bearing rings 712/713 about the ring-shaped bearing 703. A cross-section view of this engagement is shown schematically in FIG. 8. The bearing rings 712/713 slide against the wall of the ring-shaped bearing 703 such that the bearing rings 712/713 rotate freely and continuously over a full three hundred and sixty degrees without encountering a stop. In use, an archer places a finger through the hole 714 and rests the finger against the bearing rings 712/713. As the bowstring is drawn, a torque develops. The bearing rings 712/713 freely rotate over the ring-shaped bearing 703 to minimize the torque. This results in a more consistent and controlled draw. Many archers find it very difficult to consistently place their hand on a release in the same location for each consecutive shot. For example, on a first shot the archer may be high in the release and on a second shot the archer is mid-low in the release. The results of these two shots will be different. The release 600 provides a plumb bob effect to counteract this tendency. The archer can place a finger anywhere inside the bearing rings 712/713 but once the force of the bow is added the bearing rings 712/713 finds its natural center providing a more consistent angle each single shot. The release 600 allows for a more precise and uniform finger placement due to the bearing rings reaching the same position when force is applied by the archer during the draw cycle. The release reduces inconsistent placement of the finger, providing the archer consistent release alignment regardless of initial placement.

FIG. 7 also depicts a hook assembly comprising a carriage or bearing bracket 704, a bearing moon 706 and a bearing hook 711, connected about two pivot points provided by bracket pins 705. For examples of the operation of similar hook systems, see U.S. Patent Publication number 2013/0025578. Members or bolts 709 securely mount the finger extension 604 to the release body 602. A thumb barrel 707 is attached to the release body 602 to permit the archer to use his or her thumb when operating the release 600. A threaded screw 708 permits the selective adjustment of the release as described elsewhere in this specification.

Figure 9C:
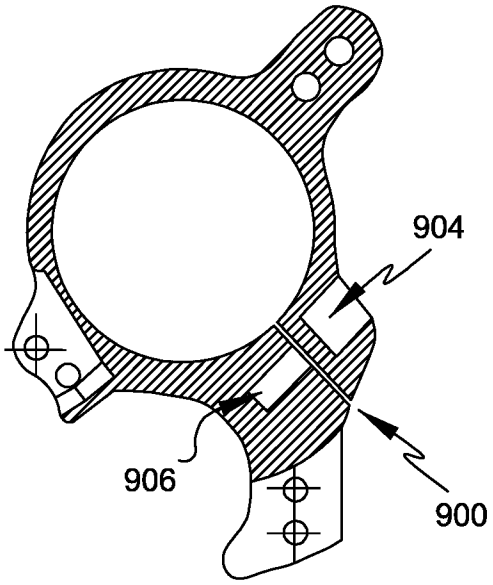
FIG. 9C is a cross section of the release body of FIG. 9A taken along line A-A.
Figure 9B:
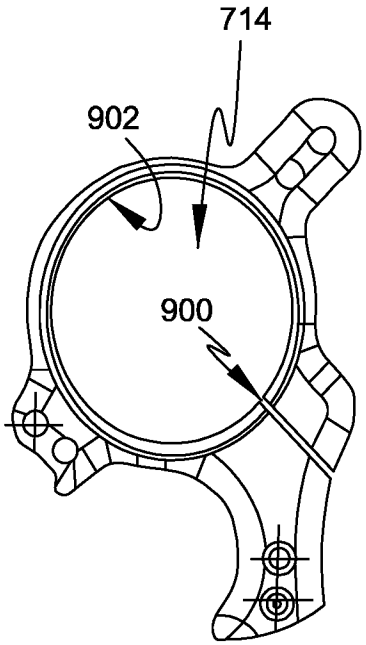
FIG. 9B is a side view of the release body of FIG. 9A.
Figure 9A:
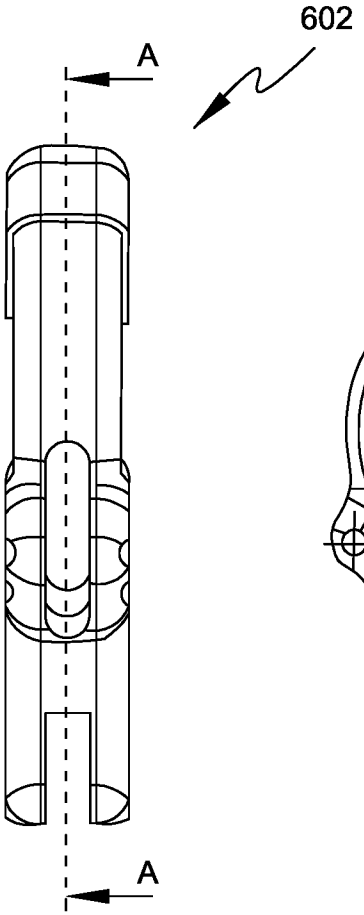
FIG. 9A is an end view of a release body.
Figure 10:
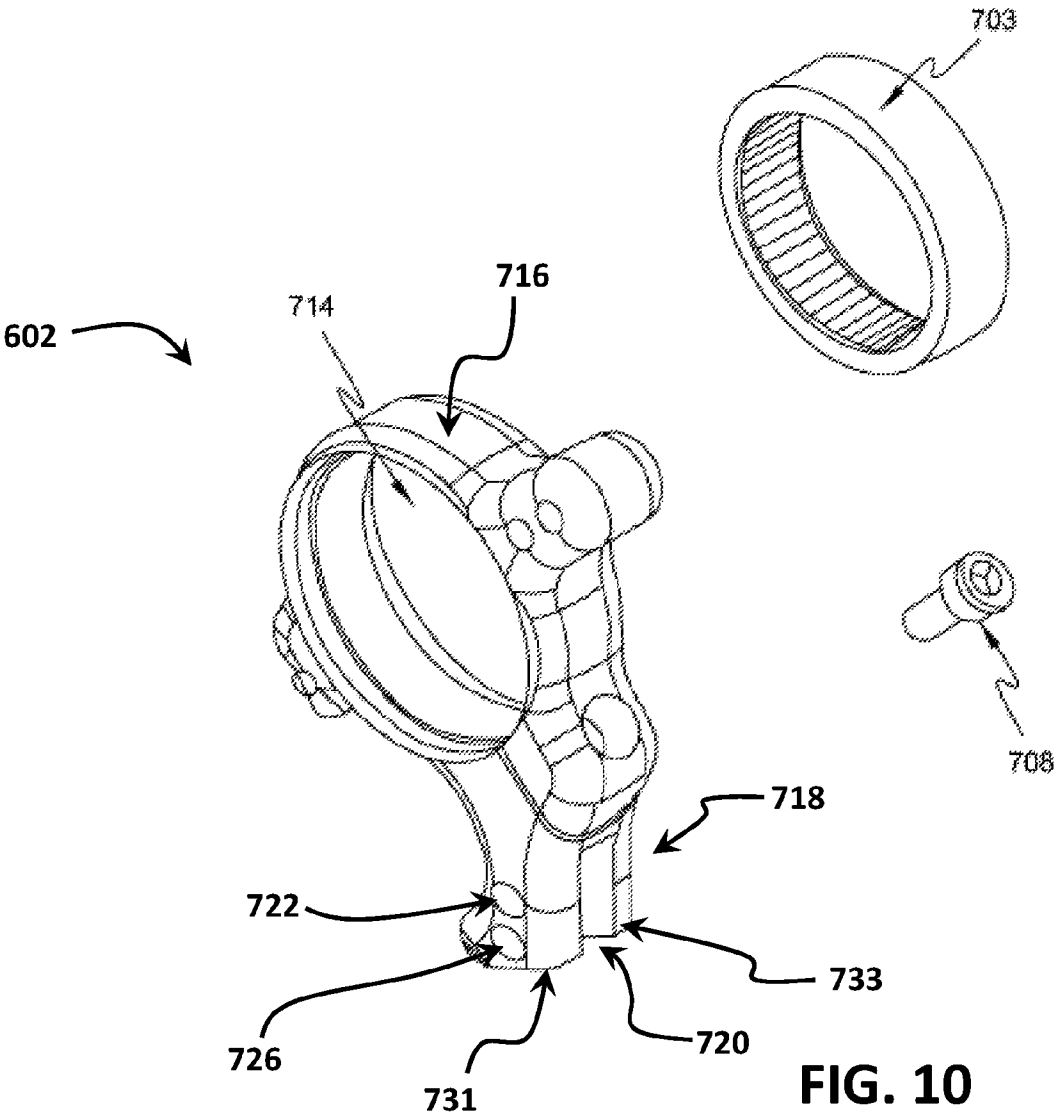
FIG. 10 is a perspective view of a release body showing a screw and a ring shaped bearing.

FIG. 9A is an end view of the release body 602 while FIG. 9B is a side view of the release body 602. FIG. 9C is a cross section view of the release body 602 taken along line A-A of FIG. 9A. The hole 714 has a continuous wall 902 except in that the wall 902 is interrupted by a gap 900. A first opening 904 is present on one side of the gap 900 and a second opening 906 is present on the opposite side of the gap 900, wherein at least one of the openings is threaded. As shown in FIG. 10, a fastener, such as the threaded screw 708, may be placed in openings 904/906 such that the threaded screw 708 bridges the gap 900. In the embodiment depicted, the second opening 906 is threaded such that actuation of the threaded screw 908 selectively adjusts a width of the gap 900. In use, the ring-shaped bearing 703 is placed within the hole and the screw 708 is actuated until the ring-shaped bearing 703 is securely engaged within the hole 714 such that the rotating bearing 703 does not rotate but permits rotation of the bearing rings 712/713. The bearing rings 712/713 are affixed about the ring-shaped bearing 703 such that the bearing rings 712/713 freely rotate. Advantageously, the adjustability provided by threaded screw 708 permits the pieces to be fabricated without needing to resort to precision manufacturing techniques, as variations in each unit can be accommodated by adjusting the threaded screw 708. Additionally, one can control how freely and smoothly the bearing rings 712/713 rotate by changing the tension on the gap 900. For example, a manufacturer may adjust the tension to an acceptable value prior to the product being shipped to a consumer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The following is claimed:

1. An archery release assembly comprising:

a body comprising:

a ring structure, wherein the ring structure comprises a first finger engagement surface configured to at least partially engage a first finger of a user;

a fork-shaped mount structure extending from the ring structure, wherein:

the fork-shaped mount structure comprises:

a second finger engagement surface configured to at least partially engage a second finger of the user; and an interference portion;

the fork-shaped mount structure comprises a plurality of supports that define:

a recess between the supports;

a first mount space extending along a first axis; and a second mount space extending along a second axis, a hook pivotally coupled to the body;

an extension comprising:

a protrusion configured to be inserted into the recess so as to be at least partially surrounded by the supports, wherein the protrusion defines a protrusion passage;

a stop portion; and a grasp comprising a third finger engagement surface configured to at least partially engage a third finger of the user;

a first member configured to:

be at least partially positioned within the first mount space;

extend along the first axis; and interface the protrusion with the fork-shaped mount structure; and a second member configured to be positioned within the second mount space, extend along the second axis and extend through the protrusion passage to couple the extension to the fork-shaped mount structure, wherein, when the protrusion is inserted into the recess: (a) the first member is at least partially positioned within the first mount space; (b) the second member is positioned within the second mount space; and (c) the second and third finger engagement surfaces define a plurality of valleys separated by a crest.

2. The archery release assembly of claim 1, wherein:

the interference portion comprises an end of the fork-shaped mount structure; and the stop portion comprises a step-shaped portion of the extension.

3. The archery release assembly of claim 1, wherein:

the interference portion comprises an inner surface of the fork-shaped mount structure;

the inner surface defines at least part of the recess; and the stop portion comprises an end of the protrusion.

4. The archery release assembly of claim 1, wherein the extension comprises a first extension and the protrusion comprises a first protrusion, the archery release assembly further comprising a second extension that is compatible with the body as an alternative to the first extension, wherein the second extension comprises: (a) a second protrusion configured to be inserted into the recess; and (b) a plurality of finger engagement surfaces configured to engage third and fourth fingers of the user.

5. The archery release assembly of claim 4, wherein the first and second protrusions are identical in shape.

6. The archery release assembly of claim 1, wherein the first member is a fastener that is non-integral with the extension.

7. The archery release assembly of claim 6, wherein the fastener is a first fastener, and the second member is a second fastener that is non-integral with the extension.

8. The archery release assembly of claim 1, comprising:

a hook carriage pivotally coupled to the body, wherein the hook is pivotally coupled to the hook carriage, and the hook is pivotal relative to the hook carriage; and a thumb support coupled to the body.

9. The archery release assembly of claim 1, wherein each of the first and second mount spaces is located outside of the recess.

10. The archery release assembly of claim 1, wherein:

the archery release assembly is a triggerless type of archery release assembly;

the archery release assembly comprises a moon member pivotally coupled to the body;

the moon member is configured to engage the hook;

when the hook is engaged with a bowstring, a rearward force applied to the archery release assembly causes the moon member to pivot and release the hook; and the released hook is configured to pivot to release the bowstring without use of any trigger.

11. The archery release assembly of claim 1, wherein the first member is configured to pivotally interface the protrusion with the fork-shaped mount structure so that, before the second member is positioned within the second mount space, the extension is configured to be pivoted relative to the body while the first member remains at a fixed X-Y location relative to the body.

12. An archery release assembly comprising:

a body comprising:

a first structure, wherein the first structure comprises a first finger engagement surface, wherein the first finger engagement surface is at least partially arc-shaped;

a second structure extending from the first structure, wherein:

the second structure comprises a plurality of spaced-apart supports, the supports define a recess located between the supports, at least one of the supports at least partially defines an axial space, wherein the axial space extends along an axis, wherein the second structure comprises a second finger engagement surface, wherein the second finger engagement surface is at least partially arc-shaped; and a hook pivotally coupled to the body;

an extension comprising:

a protrusion configured to be inserted into the recess so as to be at least partially surrounded by the supports; and a grasp comprising a third finger engagement surface, wherein the third finger engagement surface is at least partially arc-shaped; and a member configured to:

be at least partially positioned within the axial space;

extend along the axis; and couple the extension to the second structure.

13. The archery release assembly of claim 12, wherein:

the first structure comprises a ring structure defining a circular shape; and the axial space is located outside of the recess.

14. The archery release assembly of claim 12, wherein:

the axial space comprises a passage configured to receive the member; and the archery release assembly comprises a hook carriage pivotally coupled to the body, wherein the hook is pivotally coupled to the hook carriage, and the hook is pivotal relative to the hook carriage.

15. The archery release assembly of claim 12, wherein the member is a component that is separate from the extension.

16. The archery release assembly of claim 15, wherein the member comprises one of a bolt, a screw or a pin.

17. The archery release assembly of claim 12, wherein:

the axis comprises a first axis;

the axial spaces comprise a plurality of first axial spaces;

each of the supports defines a second axial space that extends along a second axis;

the first and second axes extend parallel to each other;

the member comprises a first member; and the archery release assembly comprise a second member configured to: (a) be at least partially positioned within the second axial space; (b) extend along the second axis; and (c) enable cooperation between the extension and the second structure.

18. The archery release assembly of claim 17, wherein the second member is configured to pivotally cooperate the protrusion with the second structure so that, before the first member is positioned within the first axial spaces, the extension is configured to be pivoted relative to the body while the second member remains at a fixed X-Y location relative to the body.

19. The archery release assembly of claim 17, wherein the second member is non-integral with the extension.

20. The archery release assembly of claim 12, wherein:
the extension comprises a first extension;
the protrusion comprises a first protrusion;
the grasp comprises a first grasp;
the archery release assembly comprises an extension kit;
the extension kit comprises the first extension and a second extension;
the second extension comprises a second protrusion configured to be inserted into the recess;
the second extension comprises a second grasp;
the second grasp comprises a plurality of finger engagement surfaces configured to engage third and fourth fingers of a user; and
each of the finger engagement surfaces of the second grasp is at least partially arc-shaped.

21. The archery release assembly of claim 12, wherein:
the archery release assembly is a triggerless type of archery release assembly;
the archery release assembly comprises a moon member pivotally coupled to the body;
the moon member is configured to engage the hook;
when the hook is engaged with a bowstring, a rearward force applied to the archery release assembly causes the moon member to pivot and release the hook; and
the released hook is configured to pivot to release the bowstring without use of any trigger.

22. A method for manufacturing an archery release assembly, the method comprising:
structuring a first structure so that:
the first structure comprises a first finger engagement surface; and
the first finger engagement surface is at least partially arc-shaped;
structuring a second structure so that:
the second structure extends from the first structure;
the second structure defines a recess;
the second structure at least partially defines an axial space extending along an axis, wherein the axial space is located outside of the recess;
the second structure comprises a second finger engagement surface; and
the second finger engagement surface is at least partially arc-shaped;
pivotally coupling a hook to the first structure;
structuring an extension so that:
the extension comprises a protrusion configured to be inserted into the recess;
the extension comprises a grasp;
the grasp comprises a third finger engagement surface that extends from the second finger engagement surface; and
the third finger engagement surface is at least partially arc-shaped; and
providing a member, wherein the member is configured to be at least partially positioned within the axial space so that:
the member extends along the axis; and
the member couples the extension to the second structure.

23. The method of claim 22, wherein the step of providing the member comprises providing a component configured to fit within the axial space, wherein the component is separate from the extension.

24. The method of claim 22, wherein:
structuring the first structure comprises structuring a ring structure so that the ring structure defines a circular shape;
the axis comprises a first axis;
the axial space comprises a first passage extending along the first axis;
the method comprises structuring the second structure so that the second structure defines a second passage extending along a second axis that is parallel to the first axis;
the method comprises structuring the protrusion so that the protrusion defines a protrusion passage configured to receive the member; and
the member is configured to extend through the second passage and the protrusion passage.

25. The method of claim 22, comprising:
structuring the extension so that the extension comprises a first extension;
structuring the protrusion so that the protrusion comprises a first protrusion;
structuring the grasp so that the grasp comprises a first grasp; and
structuring a second extension so that:
the second extension is configured to be inserted into the recess;
the second extension comprises a second grasp;
the second grasp comprises a plurality of finger engagement surfaces configured to engage third and fourth fingers of a user; and
each of the finger engagement surfaces of the second grasp is at least partially arc-shaped,
wherein the first and second extensions are elements of an extension kit for the archery release assembly.

26. The method of claim 22, comprising:
structuring the archery release assembly so that the archery release assembly is a triggerless type of archery release assembly;
structuring a moon member; and
pivotally coupling the moon member to the first structure so that:
the moon member is configured to engage the hook;
when the hook is engaged with a bowstring, a rearward force applied to the archery release assembly causes the moon member to pivot and release the hook; and
the released hook is configured to pivot to release the bowstring without use of any trigger.

27. The method of claim 22, comprising structuring the member so that the member is non-integral with the extension.

28. The method of claim 22, comprising structuring the member so that the member is configured to enable the protrusion to pivotally cooperate with the second structure so that the extension is configured to be pivoted relative to the first structure while the member remains at a fixed X-Y location relative to the first structure.

29. The method of claim 22, comprising:
structuring the first structure so that:
the first structure comprises a plurality of supports extending outward;
the supports are spaced apart from each other and define the recess so that the recess is located between the supports; and
at least one of the supports defines the axial space; and
structuring the extension so that the protrusion is configured to be inserted into the recess so that the protrusion is at least partially surrounded by the supports.

* * * * *